United States Patent [19]

LeBaron

[11] 4,337,005

[45] Jun. 29, 1982

[54] STRUCTURES FOR SUPPORTING MANHOLE COVERS, GRATES AND THE LIKE PROVIDED WITH SELF-STORING ADJUSTABLE LEVELING APPARATUS

[76] Inventor: Francis LeBaron, 255 East St., West Bridgewater, Mass. 02324

[21] Appl. No.: 235,042

[22] Filed: Feb. 17, 1981

[51] Int. Cl.[3] ..... E02D 29/14

[52] U.S. Cl. ..... 404/26; 52/20; 210/165

[58] Field of Search ..... 404/26, 25; 52/19, 20, 52/21; 210/165, 166

[56] References Cited

U.S. PATENT DOCUMENTS

| | | | |
|---|---|---|---|
| 638,692 | 4/1899 | Banwell . | |
| 2,930,295 | 10/1960 | Hale | 404/26 |
| 3,237,538 | 3/1966 | McPheeters | 404/26 |
| 3,240,133 | 8/1966 | Ross | 404/26 |
| 3,331,295 | 2/1967 | Sorrell | 404/26 |
| 3,408,778 | 11/1968 | Mason | 404/26 |
| 3,629,981 | 7/1971 | McCaffery | 52/19 |
| 3,858,998 | 7/1975 | Larsson et al. | 404/26 |
| 3,891,337 | 6/1975 | McCoy | 404/26 |
| 3,926,533 | 5/1975 | Binette | 404/26 |
| 4,075,796 | 9/1978 | Cuozzo | 52/20 |

*Primary Examiner*—Nile C. Byers, Jr.

*Attorney, Agent, or Firm*—Rines and Rines, Shapiro and Shapiro

[57] ABSTRACT

This disclosure is concerned with apparatus for enabling extension or other leveling adjustment of manhole cover supporting structures and the like comprising extension spacer rings resiliently compressed in self-storing fashion adjacent a support sleeve portion of the supporting structure, and adapted to be forced downward from storage to expand into position below the sleeve to extend or adjust the level of the same.

7 Claims, 4 Drawing Figures

Figure 1:
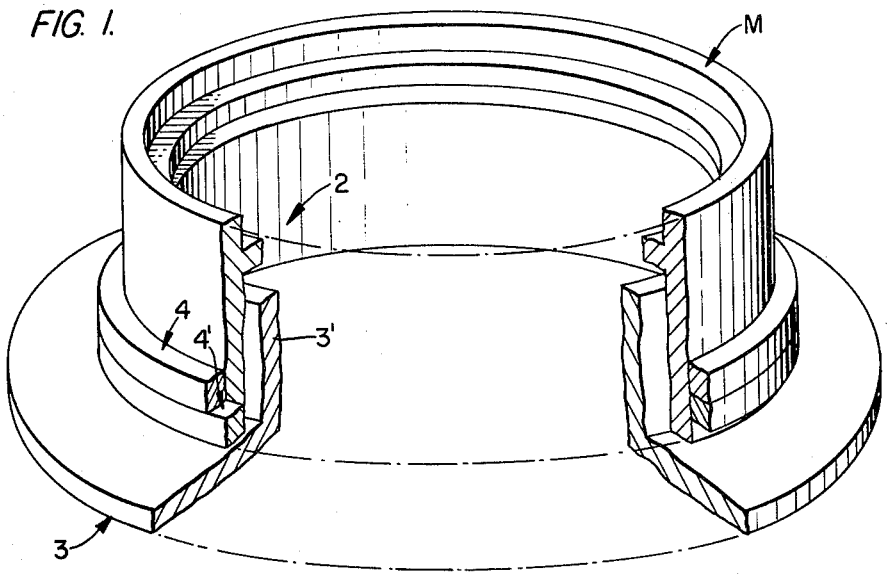

STRUCTURES FOR SUPPORTING MANHOLE COVERS, GRATES AND THE LIKE PROVIDED WITH SELF-STORING ADJUSTABLE LEVELING APPARATUS

The present invention relates to support structures for roadbed manhole covers, grates and the like, being more particularly directed to apparatus adapted to be self-stored upon the structure and operable to extend, raise or otherwise change or adjust the level of the supporting structure and thus that of the manhole cover or similar device, as may be required in road re-surfacing or other wear correction applications.

This air is replete with a wide variety of structures proposed and used through many years to try to provide a facile construction for these and related purposes. As examples, concentric rotational adjustment structures date back before the turn of the century, at least to U.S. Pat. No. 638,692, with recent threaded versions appearing in U.S. Pat. Nos. 3,629,981 and 4,075,796. Bolts and similar mechanisms for adjusting the support level are illustrated in U.S. Pat. Nos. 2,930,295 and 3,858,998. Special inserts, including extension rings, are described in, for example, U.S. Pat. Nos. 3,240,133; 3,331,295; and 3,926,533. These and other similar constructions have left much to be desired, apart from either requiring separate inserts or devices or relatively costly or awkward mechanisms, including threaded or specially shaped mechanisms, often requiring additional thickness of repaving to be required to use the inserts, and hazardous instability problems, such as wobbling, in the event perfect fits are not always attained or mechanisms become loosened, wear or are dislodged.

It is to the improved solution of these problems that the present invention is accordingly directed; it being an object of the invention to provide a novel apparatus for providing adjustable leveling of manhole covers, grates and the like, that shall not be subject to the above-described disadvantages and others of the prior art, but that, to the contrary, shall provide for self-storage of simple extension apparatus, with relatively inexpensive and reliable construction.

A further object is to provide such an improved manhole cover or similar adjustable-level support structure that does not require departure from present-day types of installations, but can readily be adapted for use with a wide variety of current support structures.

Other and further objects will be explained hereinafter and are more particularly delineated in the appended claims. In summary, the invention contemplates apparatus for providing adjustable leveling of manhole covers, grates and the like within ground and similar structures, having, in combination, a tubular slip ring for supporting a cover, grate and the like near its upper edge, a base ring having a bottom flange mounting a tubular vertical sleeve positioned to receive the slip ring in coaxial telescopic relationship, and resilient spacer ring means fitted under tension coaxially against a wall of the slip ring near its lower edge and adapted, upon lifting of the slip ring along the base ring sleeve, to be forced down and snapped under the said lower end of the slip ring and against the base ring flange, to elevate the level of the slip ring and thus that of the manhole cover, grate and the like. Preferred details and best mode embodiments are hereinafter presented.

Figure 2:
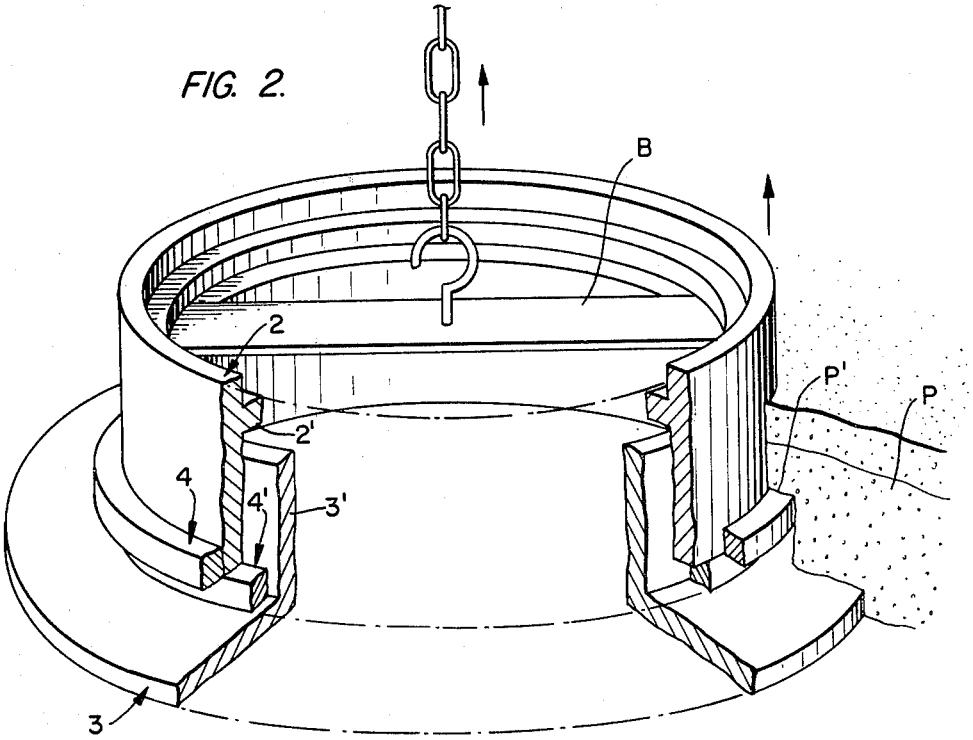
Figure 3:
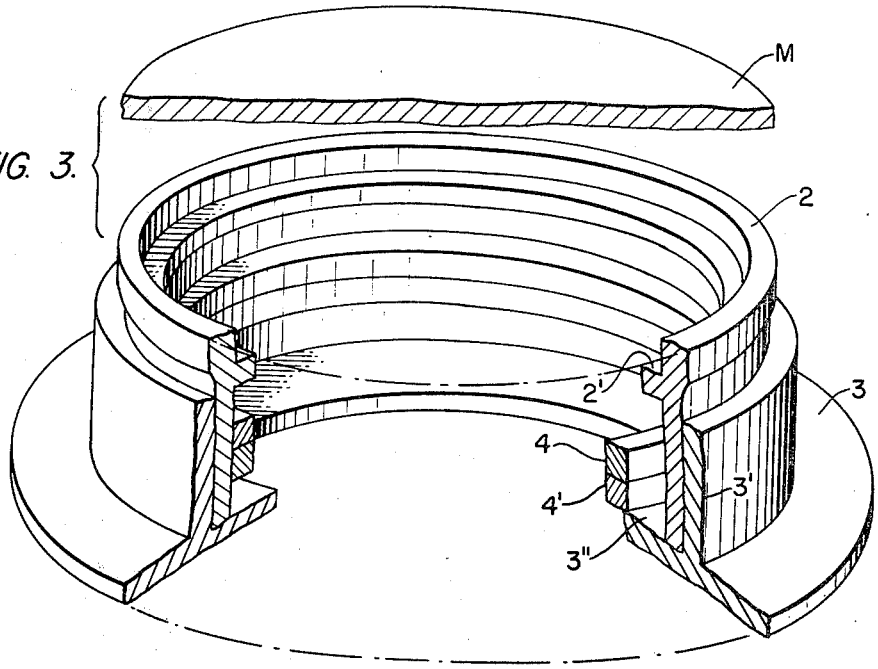
Figure 4:
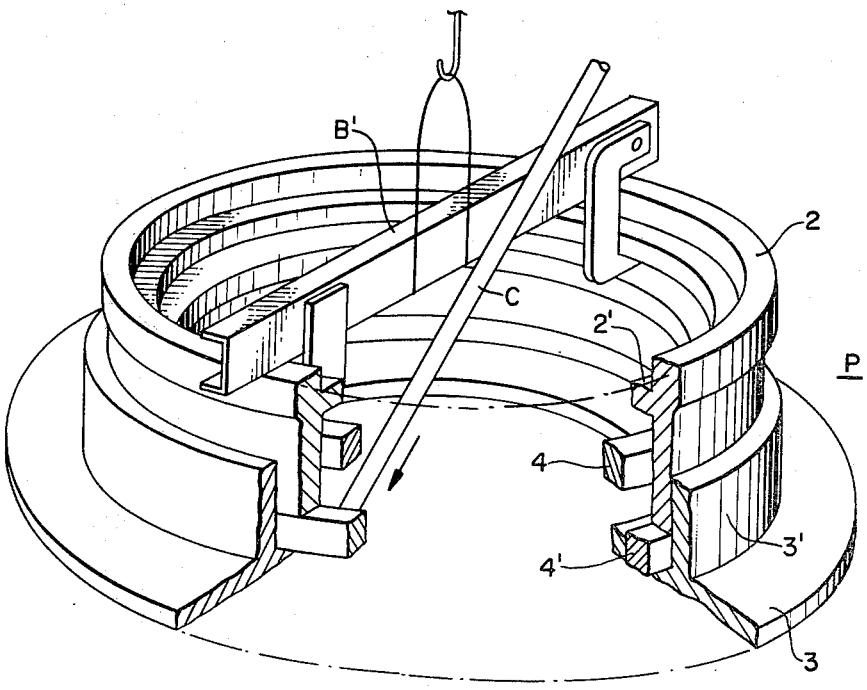

The invention will now be described with reference to the accompanying drawing,

FIG. 1 of which is an isometric view, partly cut away, showing a preferred supporting structure constructed in accordance with the invention, with self-stored external extension rings;

FIG. 2 is a view similar to FIG. 1, illustrating the system of FIG. 1 installed in a roadbed or pavement and in the process of being extended or adjusted to a raised level; and FIGS. 3 and 4 are views corresponding, respectively, to FIGS. 1 and 2 of a modified structure with internally stored extension rings.

Referring to FIG. 1, the manhole, grate or similar supporting structure is depicted in the form of an annular base ring having a bottom flange 3 interiorly extending vertically upward into, and mounting, a cylindrical tubular sleeve 3' coaxially inserted within a taller tubular cylindrical slip ring 2 in telescopic relationship. The bottom edge of the slip ring 2 rests on the flange 3 at its innermost region adjacent the bottom of the sleeve 3', and is adapted to receive the manhole, grate or the like upon its upper edge, as indicated by the letter M, with the ground, concrete or other pavement or related surfacing built up around the supporting structure 3–3'–2, as more particularly shown in FIG. 2.

In accordance with the invention, cylindrical extension spacers 4, 4', etc. in the form of transversely cut or gapped or slit resilient rings, snap-fitted under tension coaxially against the outer wall surface of the slip ring 2 in successive positions upward from the bottom edge thereof, are provided to enable leveling adjustment. When it is required to elevate the manhole supporting structure, (say, the height of one stored ring), it is merely necessary to insert a lifting bar B, FIG. 2, under the internal flange 2' near the top edge of the slip ring 2, and to lift upward. As the slip ring 2 is lifted upward telescopically along or against the outer wall of the base ring sleeve 3', this causes the pavement P at region P' packed over the stored spacer rings to bear against the rings 4, 4', forcing them downwardly upon the slip ring 2, until the lower ring 4' slips under the bottom edge of the slip ring 2 and snaps into place thereunder against the base ring flange 3, as an elevating extension spacer. Similar remarks apply for further leveling adjustments that may require additional self-stored spacer(s) 4, etc.

In actual practice, for an approximately ¾-inch thick slip ring 2 of approximately 28 inches outer diameter, the ring spacers 4, 4', etc., snap-fitted under tension externally around the slip ring 2, may have about a 5-inch gap at the region of transverse cut or slit, and may be made of resilient steel bands also about ¾-inch in thickness.

If desired, the extension spacer rings 4, 4', etc., moreover, may be stored against the inner surface of the slip ring 2, as shown in FIG. 3; in which event, the slip ring 2 is fitted within and at the inner surface of the base sleeve 3', resting upon an inner flange 3'' of the base. The internally stored transversely cut or slit spacer rings are sufficiently short to be force-fitted inside the slip ring 2. Approximately the same 5-inch ring gap, for a 26-inch inner diameter slip ring 2, may be used. To effect leveling adjustment, as by raising the height one ring 4', the slip ring 2 may be elevated by a beam B', FIG. 4, clamped below the flange 2', while a crow bar C is used to force the extension spacer ring 4' down under the bottom edge of the slip ring 2 so that it may spring outward into position below such bottom edge, as shown.

While two extension rings 4, 4' are actually shown, clearly more may be employed, and they need not be of the same height dimensions. In all events, the structure stores its own extension elements and no external devices are required. This technique, furthermore, may be used with other supporting structures than the type shown having surfaces that will permit of snap-fitted external or internal attachment, or both, and release. Further modifications will also occur to those skilled in this art and such are considered to fall within the spirit and scope of the invention as defined in the appended claims.

What is claimed is:

1. Apparatus for providing adjustable leveling of manhole covers, grates and the like within ground and similar structures, having, in combination, a tubular slip ring for supporting a cover, grate and the like near its upper edge, a base ring having a bottom flange mounting a tubular vertical sleeve positioned to receive the slip ring in coaxial telescopic relationship, and resilient spacer ring means fitted under tension coaxially against a wall of the slip ring near its lower edge and adapted, upon lifting of the slip ring along the base ring sleeve, to be forced down and snapped under the said lower end of the slip ring and against the base ring flange, to elevate the level of the slip ring and thus that of the manhole cover, grate and the like.

2. Apparatus as claimed in claim 1 and in which said resilient spacer ring means is fitted against the external wall of said slip ring.

3. Apparatus as claimed in claim 2 and in which said slip ring is coaxially mounted external to said base ring sleeve.

4. Apparatus as claimed in claim 1 and in which said resilient spacer ring means is fitted within and against the inner wall of said slip ring.

5. Apparatus as claimed in claim 4 and in which said slip ring is coaxially mounted within said base ring sleeve.

6. Apparatus as claimed in claim 1 and in which said spacer ring means comprises a plurality of successive spacer rings.

7. Apparatus as claimed in claim 1 and in which said spacer ring means comprises a transversely cut resilient spacer ring.

* * * * *